US006070506A

United States Patent [19]

Becker

[11] Patent Number: 6,070,506

[45] Date of Patent: Jun. 6, 2000

[54] RATCHET HEAD ELECTRONIC TORQUE WRENCH

[75] Inventor: Thomas P. Becker, Kenosha, Wis.

[73] Assignee: Snap-on Tools Company, Kenosha, Wis.

[21] Appl. No.: 09/118,873

[22] Filed: Jul. 20, 1998

[51] Int. Cl.[7] ..... B25B 23/14

[52] U.S. Cl. ..... 81/479; 73/862.143; 73/862.08; 81/478

[58] Field of Search ..... 81/467, 479, 478; 73/862.193, 862.08, 862.26, 862.34, 862.325

[56] References Cited

U.S. PATENT DOCUMENTS

| | | | |
|---|---|---|---|
| 2,250,941 | 7/1941 | Zimmerman | 81/477 |
| 2,289,238 | 7/1942 | Brunelle | 81/477 |
| 3,525,256 | 8/1970 | Crooks et al. | 73/862.26 |
| 3,967,513 | 7/1976 | Myrdal . | |
| 3,970,155 | 7/1976 | Otto | 73/862.26 |
| 4,073,187 | 2/1978 | Avdeef | 73/862.325 X |
| 4,226,127 | 10/1980 | Hardiman . | |
| 4,314,490 | 2/1982 | Stone . | |
| 4,328,709 | 5/1982 | Schramm . | |
| 4,385,276 | 5/1983 | Bitzel . | |
| 4,412,158 | 10/1983 | Jefferson et al. . | |
| 4,522,075 | 6/1985 | Pohl | 73/862.26 X |
| 4,549,438 | 10/1985 | Grabovac et al. . | |
| 4,558,601 | 12/1985 | Stasiek et al. . | |
| 4,561,332 | 12/1985 | Wood . | |
| 4,562,746 | 1/1986 | Petit . | |
| 4,615,220 | 10/1986 | Johansson . | |
| 4,643,030 | 2/1987 | Becker et al. . | |
| 4,664,001 | 5/1987 | Denman . | |
| 4,665,756 | 5/1987 | Snyder . | |
| 4,669,319 | 6/1987 | Heyraud . | |
| 4,704,896 | 11/1987 | Parsons . | |
| 4,762,007 | 8/1988 | Gasperi et al. . | |
| 4,765,416 | 8/1988 | Bjerking et al. . | |
| 4,791,839 | 12/1988 | Bickford et al. . | |
| 4,805,464 | 2/1989 | Grabovac . | |
| 4,854,764 | 8/1989 | Faber et al. . | |
| 4,864,841 | 9/1989 | Heyraud | 73/862.26 X |
| 4,874,996 | 10/1989 | Rosenthal . | |
| 4,875,292 | 10/1989 | Gibson . | |
| 4,954,004 | 9/1990 | Faber et al. . | |
| 4,976,159 | 12/1990 | Snyder et al. . | |
| 4,982,612 | 1/1991 | Rittmann | 73/862.26 X |
| 4,992,948 | 2/1991 | Pilland . | |
| 5,116,094 | 5/1992 | Jones . | |
| 5,172,616 | 12/1992 | Negishi . | |
| 5,181,575 | 1/1993 | Maruyama et al. . | |
| 5,230,262 | 7/1993 | Ahlund et al. . | |
| 5,303,601 | 4/1994 | Schonberger et al. . | |
| 5,365,155 | 11/1994 | Zimmermann . | |
| 5,435,190 | 7/1995 | Jansson et al. . | |
| 5,476,014 | 12/1995 | Lampe et al. . | |
| 5,520,059 | 5/1996 | Garshelis . | |
| 5,537,877 | 7/1996 | Hsu . | |
| 5,589,644 | 12/1996 | Becker et al. . | |
| 5,651,667 | 7/1997 | Sand et al. . | |

OTHER PUBLICATIONS

P. 45 of CDI catalog for Micrometer Adjustable Rubber Gripp Down Handle, Model 2000MF. (Feb. 1997).

P. 47 of CDI catalog for Pre–Set "Clicker" Interchangeable Head Wrenches. (Feb. 1997).

*Primary Examiner*—David A. Scherbel
*Assistant Examiner*—Anthony Ojini
*Attorney, Agent, or Firm*—Seyfarth, Shaw, Fairweather & Geraldson

[57] ABSTRACT

A ratcheting electronic torque wrench has an input beam in the form of a hollow housing with a handle end and a work end, a ratchet head disposed within the work end of the housing and rotatable relative thereto and a reaction beam disposed within the housing and having one end fixed to the ratchet head for pivoting therewith about the axis thereof and an input end resiliently urged to a neutral position relative to the housing by two bias springs respectively engaging opposite sides of the reaction beam. A Hall-effect sensor carried by the input end of the reaction beam is disposed between two permanent magnets and is powered by a battery for producing an output indicative of reaction beam movement, which is proportional to applied torque. A display circuit can display the applied torque or a predetermined torque level set by a preset circuit. An alarm signal is generated when the applied torque reaches the predetermined level.

12 Claims, 2 Drawing Sheets

RATCHET HEAD ELECTRONIC TORQUE WRENCH

BACKGROUND OF THE INVENTION

The present invention relates to torque-applying and measuring apparatus, such as torque wrenches and, in particular, to electronic torque wrenches of the type which can display the applied torque level and/or a predetermined alarm torque level.

One standard type of torque wrench utilizes two beams which are interconnected at one end, but not at the other. One beam is rigid and the other is flexible in response to applied torque so as to produce relative movement with respect to the adjacent end of the rigid or inflexible beam, which movement is measured by an appropriate scale. This type of torque wrench is capable of measuring and indicating the actual value of torque being applied. Electronic versions of such wrenches typically utilize a strain gauge bending beam, the strain gauges being arranged with associated circuitry to cancel the effects of hand-hold position on the wrench handle.

Another type of torque wrench is the "click" type, in which the two beams are both rigid, and their free ends are coupled together by an adjustable spring-biased mechanism designed to yield and allow one of the beams to pivot relative to the other when a predetermined torque corresponding to the adjustable spring bias is reached. This pivoting movement typically produces a tactile vibration and an associated audible sound or "click" to signify that the predetermined torque level has been reached. This type of wrench is affected by hand-hold position errors.

In the bending-beam type of torque wrench, if a ratchet head is to be used it must be attached between the bending beam drive and the work, thus undesirably extending the drive configuration below the wrench body. Alternatively, a ratchet head can be attached in front of the bending beam drive necessitating an adjustment in reading to compensate for the "effective length" of the wrench configuration. This configuration is also subject to reading inaccuracies due to hand-hold position.

Similarly, the prior "click"-type torque wrench must typically be enlarged to accommodate a ratchet drive head and would necessarily add thickness or extension to the wrench body.

A prior "click"-type torque wrench provided by Consolidated Devices Inc. under Model No. 20005MF utilizes a pivoting beam which pivots about the torquing axis of the head, thereby eliminating hand-hold position errors. But this is a mechanical wrench and has the disadvantage of other "click"-type torque wrenches in that it cannot measure actual torque applied, but can only detect when a predetermined torque level is reached.

SUMMARY OF THE INVENTION

It is a general object of the invention to provide an improved torque wrench which avoids the disadvantages of prior wrenches while affording additional structural and operating advantages.

An important feature of the invention is the provision of a torque wrench which is of economical construction and which is characterized by ease of use.

Another feature of the invention is the provision of a torque wrench which avoids the disadvantages of both bending beam-type and "click"-type torque wrenches.

Still another feature of the invention is the provision of a torque wrench which has a ratcheting head which does not enlarge the overall profile of the wrench.

Still another feature of the invention is the provision of an electronic torque wrench of the type set forth, which provides an inexpensive and accurate measurement and display of applied torque.

Yet another feature of the invention is the provision of a torque wrench of the type set forth, which avoids hand-hold position errors.

A still further feature of the invention is the provision of a pivoting-beam type of torque wrench which is capable of measuring and displaying applied torque.

Certain ones of these and other features of the invention may be attained by providing a torque wrench comprising: an elongated torque input beam having a handle end and a work end, a work-engaging head rotatably carried by the input beam at the work end thereof, an elongated output beam disposed substantially parallel to the input beam and having an output end fixed to the head for rotation therewith and an input end, a bias mechanism coupling the input beam to the input end of the output beam and resiliently urging the input end to a neutral position relative to the input beam while accommodating continuous movement of the input end from the neutral position a distance which is a function of the amount of torque applied, and an indicator responsive to movement of the input end from the neutral position for providing an indication of torque applied.

Other features of the invention may be attained by providing a low-profile ratcheting torque wrench comprising: an elongated torque input housing having a predetermined maximum thickness and having a handle end and a work end, a ratchet head mounted within the housing at the work end thereof for rotation relative thereto about an axis and having a work-engaging lug projecting from the housing along the axis, an elongated output beam disposed within the housing and coupled to the ratchet head and movable relative to the housing in response to applied torque, and an electronic indicator carried by the housing and responsive to relative movement between the housing and the output beam for providing an indication of torque applied.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
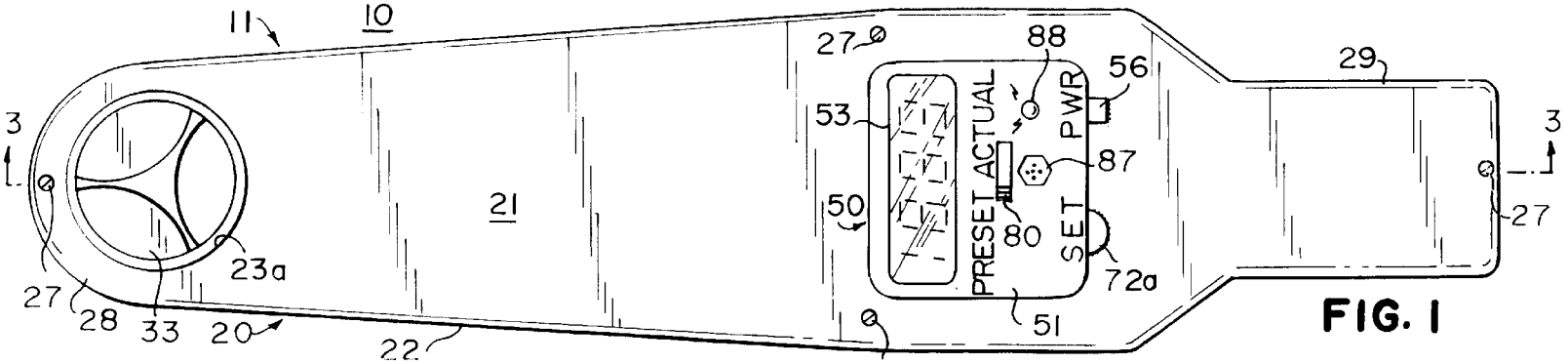
FIG. 1 is a top plan view of a torque wrench constructed in accordance with and embodying the features of a first embodiment of the present invention.
Figure 2:
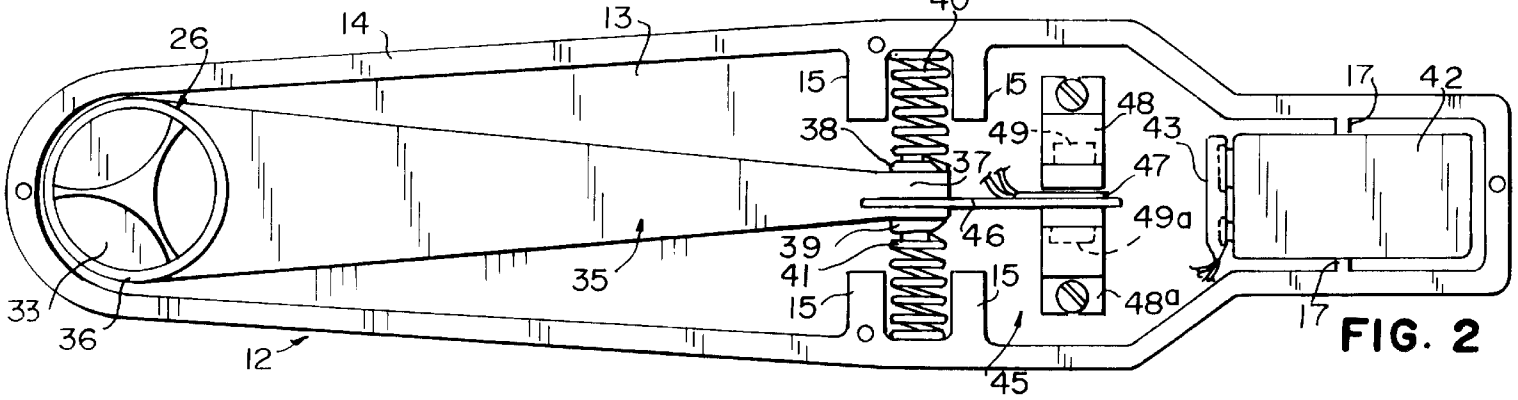
FIG. 2 is a top plan view of the bottom half of the torque wrench of FIG. 1 with the cover removed.
Figure 3:
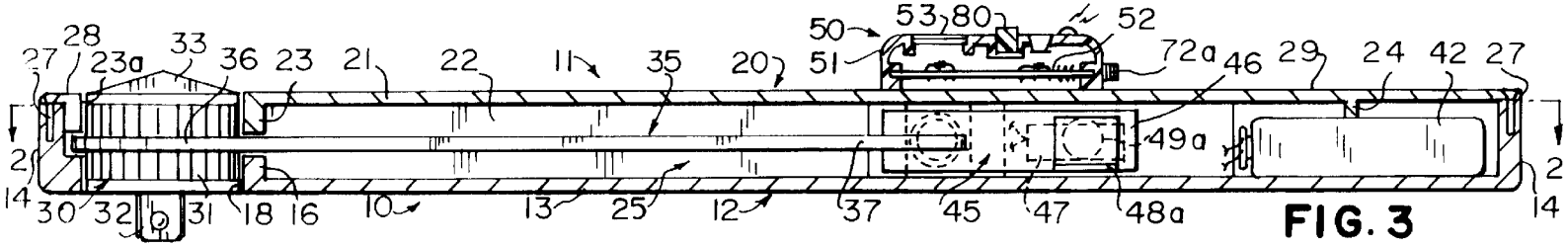
FIG. 3 is a view in vertical section taken along the line 3—3 in FIG. 1.

Referring to FIGS. 1–3, there is illustrated a torque wrench, generally designated by the numeral 10, which has an elongated, rigid housing 11, which forms an input beam for the toque wrench. The housing 11 is of two-part construction, having a base 12 with a bottom wall 13 and an upstanding peripheral side wall 14. Projecting laterally inwardly from the opposite sides of the peripheral side wall 14 are two pairs of longitudinally-spaced flanges 15. Upstanding from the bottom wall 13 adjacent to the forward end of the base 12 is an arcuate partition 16. Short flanges 17 project laterally inwardly from the opposite sides of the peripheral side wall 14 adjacent to the rear end thereof. The bottom wall 13 has an opening 18 formed therethrough forwardly of the partition 16.

The housing 11 also includes a cover 20 which is substantially congruent with the base 12 and has a top wall 21 and a depending peripheral side wall 22. An arcuate partition 23 depends from the top wall 21 near the front end thereof. A spacer flange 24 depends from the top wall 21 adjacent to the rear end thereof. The top wall 21 has a circular opening 23*a* formed therein forwardly of the partition 23. In use, the cover 20 fits over the base 12 in congruent fashion, cooperating to define therebetween a main chamber 25 disposed rearwardly of the partitions 16 and 23 and a forward or head chamber 26 disposed forwardly of the partitions 16 and 23. Preferably, the cover 20 is secured to the base 12 with a plurality of suitable fasteners 27 to form a housing which has a rounded front work end 28 and side walls which diverge slightly therefrom rearwardly to an enlarged-width sensor area and then tapers back down to a narrow handle end 29.

Mounted in the work end 28 of the housing 11 is a ratchet head 30, which includes a ratchet mechanism of known construction disposed entirely within the head chamber 26 and having a square drive lug 32 which projects downwardly through the opening 18 below the bottom wall 13 for engagement with an associated socket or other work piece. The ratchet mechanism 31 is also provided with a reversing knob 33 which projects upwardly through the opening 23*a* above the top wall 21.

The torque wrench 10 includes an elongated, rigid reaction or output beam 35 in the form of a flat plate. The beam 35 has a generally elongated teardrop shape, with a rounded output end 36 fixed to the ratchet mechanism 31, and projecting radially outwardly therefrom a slight distance to provide a flange which fits between the mating portions of the base 12 and cover 20 to retain the ratchet head 30 in place, while accommodating rotational movement thereof relative to the housing 11. The beam 35 has a narrow input end 37 which terminates between the pairs of flanges 15 and is provided with bearing pads 38 and 39, respectively on its opposite side edges. Helical compression springs 40 an 41 are respectively seated in the receptacles defined by the pairs of flanges 15, and respectively engage the bearing pads 38 and 39 to resiliently urge the reaction beam 35 to a neutral position substantially centered in the housing 11 along the longitudinal axis thereof.

The handle end 29 of the housing 11 defines a battery compartment for receiving a suitable battery 42, which is trapped laterally between the flanges 17 and vertically between the bottom wall 13 and the spacer 24. A terminal coupler 43 connects the battery terminals to the remainder of the circuitry, to be described below.

The torque wrench 10 also includes a Hall-effect sensor assembly 45, including an elongated, thin, rectangular holder 46 fixed to the input end 37 of the reaction beam 35 and projecting rearwardly therefrom, and carrying a Hall-effect sensor 47 thereon. Fixed on the bottom wall 13 are two laterally-spaced magnet brackets 48 and 48*a,* respectively carrying permanent magnets 49 and 49*a,* disposed so that the Hall-effect sensor 47 is positioned midway therebetween in the neutral position of the reaction beam 35. The Hall-effect sensor 47 provides a voltage output that is a function of its absolute position within the magnetic field.

In practice, force applied to the wrench handle end 29 is transmitted to the reaction beam 35 through one of the springs 40 and 41, depending upon the direction of rotation. The reaction beam 35 works the ratchet head 30, thus applying torque to the work piece. Compression of the spring allows a predicted angular rotation of the ratchet head relative to the housing 11 about the axis of the ratchet head 30. Rotational displacement of the spring-loaded input end 37 of the reaction beam 35 moves the Hall-effect sensor 47 toward one of the permanent magnets 49 or 49*a,* increasing the influence of its magnetic field. The resulting output voltage variation from the sensor is measured and displayed in units of torque, as described below.

Figure 5B:
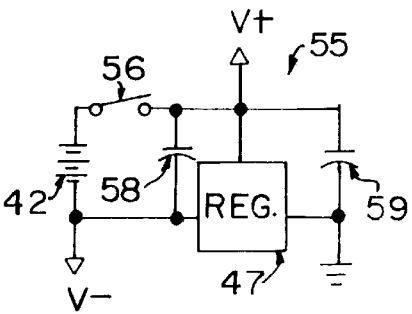
FIGS. 5A–5B are schematic circuit diagrams of the torque sensing and indicating circuitry of the torque wrench of FIGS. 1–3.

Mounted on the cover 20 is an indicator module 50, which includes a generally box-like housing 51 carrying therein a circuit board 52 and having a rectangular display window 53 in the top wall thereof. It will be appreciated that conductors from the battery terminal coupler 43 and from the Hall-effect sensor 47 are connected to the circuit board 52 through a suitable opening (not shown) in the top wall 21. Referring to FIG. 5B, the circuit board 52 includes a power supply circuit 55 which is coupled across the battery 42 through a power switch 56, the actuator for which projects from the rear wall of the indicator housing 51 (FIG. 1). The battery 42 is connected across two terminals of a voltage regulator 47 in parallel with a filter capacitor 58, for respectively producing at these terminals V+ and V− DC supply voltages. The voltage regulator 47 provides a regulated circuit ground at 5 volts below the V+ supply. A filter capacitor 59 is connected across the V+ supply and ground.

Figure 5A:
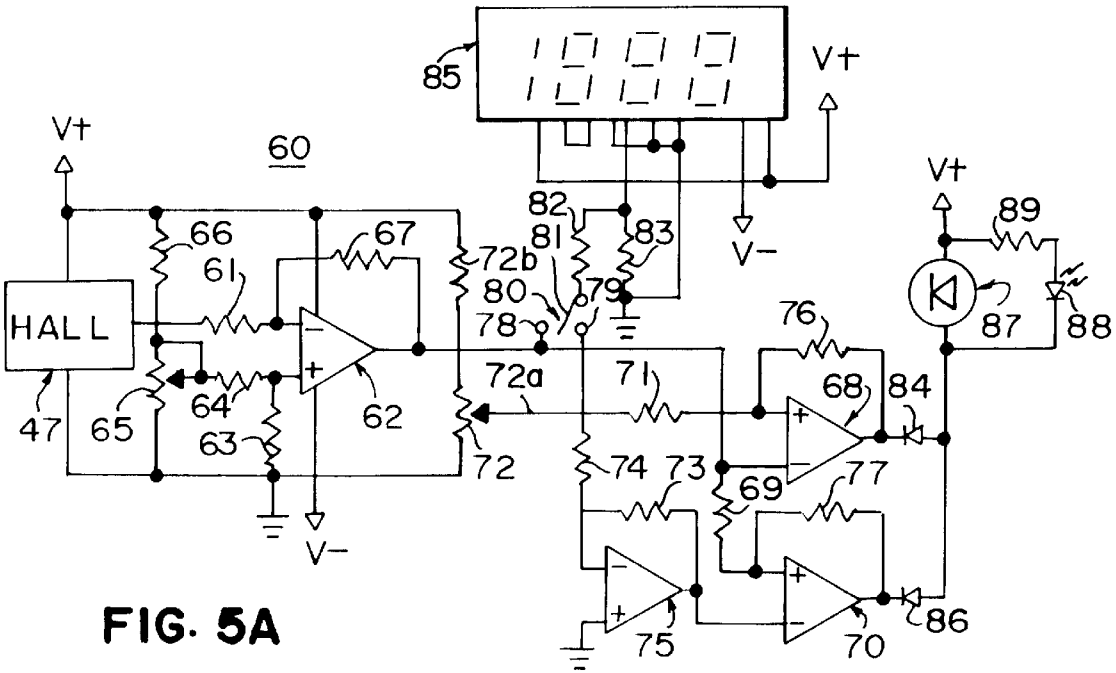

Referring to FIG. 5A, the circuit board 52 also includes an indicator circuit 60. The Hall-effect sensor 47 is connected across the V+ supply and ground and has an output which is applied through a resistor 61 to the inverting terminal of an operational amplifier ("op amp") 62. The non-inverting input of the op amp 62 is connected to ground through a resistor 63 and, through a resistor 64, to the junction between a potentiometer 65 and a resistor 66 connected in series across the V+ supply and ground, the resistor 64 also being connected to the wiper of the potentiometer 65. The output of the op amp 62 is connected to its inverting input through a resistor 67.

The output of the op amp 62 is also connected to the inverting input of an op amp 68 and, through a resistor 69, to the non-inverting input of an op amp 70. The non-inverting input of the op-amp 68 is connected through a resistor 71 to the wiper 72*a* of a potentiometer 72, which is connected in series with a resistor 72*b* across the battery 42. The wiper 72*a* of potentiometer 72 is also connected through a resistor 74 to the inverting input of an inverter op amp 75, the output of which is connected to the inverting input of op amp 70 and through resistor 73 to its own inverting input. The non-inverting input of op amp 75 is connected to ground. The outputs of the op amps 68 and 70 are, respectively, connected to their non-inverting inputs through resistors 76 and 77.

The wiper 72*a* of the potentiometer 72 is connected to one fixed contact 78 of a single-pole, double-throw switch 80, the other fixed contact 79 of which is connected to the output of the op amp 62. The switch 80 has a movable contact 81 connected through a resistor 82 to the input of a display unit 85, which may be a digital voltmeter display, such as a Summit S160015, that input also being connected to ground through a resistor 83. The display 85 is provided with V+ and V− supply voltages.

The outputs of the op amps 68 and 70 are, respectively, connected to the cathodes of diodes 84 and 86, the anodes of which are connected through an annunciator horn 87 to the V+ supply. An indicating LED 88 and a resistor 89 are connected in series across the horn 87. The op amps 62, 68, 70 and 75 may be part of an integrated circuit quad amp, such as an LM324, which is provided with the V+ and V− supply voltages, this connection being illustrated at the op amp 62.

In operation, the output signal of the Hall-effect sensor 47 is fed to the inverting input of the op amp 62, configured as a differential amplifier. The potentiometer 65 is a zero-adjust trimmer which, in series with the resistor 66 establishes a reference voltage applied to the non-inverting input of the differential amplifier through resistor 64. The amplifier gain is established by the ratios of the resistors 61 and 67 and the resistors 64 and 63, preferably providing ±2 V for ±200 inch lbs. of torque applied. It will be appreciated that the gain is also a function of the magnetic field strength and the distance between the magnets 49 and 49*a*.

The potentiometer 72 is a preset-adjust potentiometer which, in series with the range resistor 72*b*, varies between approximately +0.2 volts and +2.0 volts. This preset voltage is fed to the digital voltmeter display unit 85 when the switch 80 is in the preset position, illustrated in FIG. 5A, the actuator for switch 80 being disposed on the top of the indicator housing 51. The preset voltage is also directed to the op amps 68 and 70, configured as voltage comparators. The op amp 68 compares the preset voltage to the positive (clockwise torque input) output voltage from the Hall-effect sensor 47, while the op amp 70 compares the preset voltage to the Hall sensor output applied through the inverting amplifier 75 with a gain of −1, as established by the ratio of resistors 73 and 74, which corresponds to the negative (counterclockwise torque input) voltage. The outputs from both comparators are diode OR'ed through diodes 84 and 86 to drive the horn 87, which may be a piezo sounder, and the LED 88, which are located on the indicator housing 51.

Thus, when the switch 80 is in the position illustrated in FIG. 5A, the display unit 85 will display the torque corresponding to the preset level as set by the potentiometer 72, the wiper 72*a* of which is coupled to a thumbwheel on the indicator housing 51 (FIG. 1), and the alarm indicators will be actuated when this preset torque level is reached. When the switch 80 is in the other position, with the movable contact 81 connected to the fixed contact 79, the actual output voltage of the Hall-effect sensor circuit is applied to the display unit 85, which displays the actual torque being applied. In this mode, the alarm horn 87 and LED 88 will still operate in the same manner when the preset torque is reached.

In a constructional model of the invention, the battery is a 9-volt NiCad battery, and the voltage regulator is a 7905 regulator, with the V+ supply being +5 volts and the V− supply being −4 volts. The Hall-effect sensor 47 may be any of a number of available types, such as a model SS94A1 made by Honeywell Micro Switch or a model OHS35OU made by Optek. Such sensors provide a ratiometric output, i.e., zero output is established as one-half the supply voltage. Preferably, the magnets 49 and 49*a* are neodymium magnets.

Figure 4:
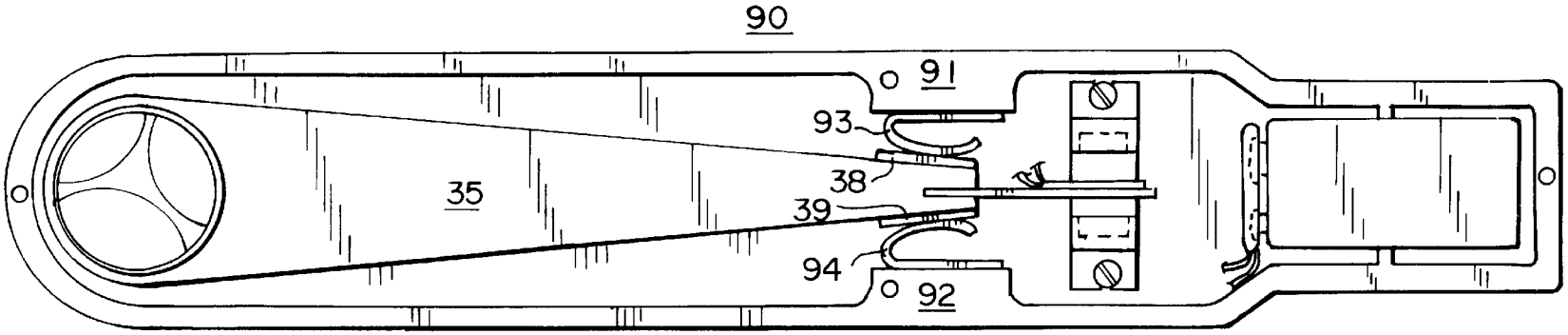
FIG. 4 is a view similar to FIG. 2 of an alternative form of torque wrench.

Referring to FIG. 4, there is illustrated an alternative embodiment of torque wrench, generally designated by the numeral 90, which is similar to the torque wrench 10, except for the biasing mechanism for the reaction beam and the shape of the housing, which provide for a narrower construction. In this case, the housing has parallel sides and is provided with a pair of opposed, inwardly projecting posts or lugs 91 and 92, respectively carrying leaf springs 93 and 94 which, respectively, engage the bearing pads 38 and 39 of the reaction beam 35. It will be appreciated that other types of biasing arrangements could also be used.

There have been disclosed herein relatively simplified versions of the torque wrenches of the present invention. It will be appreciated that various modifications could be made. Thus, for example, various bearing materials, techniques or lubrications could be utilized to minimize friction between the wrench handle and the ratchet head. Also, in lieu of the op amp circuitry disclosed, it will be appreciated that micro-controller technology could be utilized and such technology could implement correction factors or look-up tables to minimize measurement error which might occur as a result of non-linearities inherent in Hall-effect sensors, spring displacements under load, sensor position offsets due to reaction beam rotation or environmental effects, all of which effects are predictable. Also, it will be appreciated that, in lieu of the Hall-effect sensor, alternative means could be utilized to detect and measure the motion of the reaction beam 35, such as mechanical dial mechanisms, potentiometers, optical encoders, linear variable displacement transformers, load cells and the like.

From the foregoing, it can be seen that there has been provided an improved torque wrench which utilizes a pivoting reaction beam, similar to that utilized in "click"-type torque wrenches, but which avoids the disadvantages of such wrenches, permitting readout of actual torque applied and avoiding handhold position errors, while at the same type permitting use of a ratchet head without increasing the overall thickness profile or length of the wrench.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A torque wrench comprising:

an elongated torque input beam having a handle end and a work end, a work-engaging head rotatably carried by said input beam at the work end thereof, an elongated output beam disposed substantially parallel to said input beam and having an output end fixed to said head for rotation therewith and an input end, a bias mechanism coupling said input beam to the input end of said output beam and resiliently urging said input end to a neutral position relative to said input beam while accommodating continuous movement of said input end from said neutral position a distance which is a function of the amount of torque applied, said bias mechanism including two springs respectively engaging opposite sides of said output beam and respectively urging it in opposite directions, and an indicator responsive to movement of said input end from said neutral position for providing an indication of torque applied.

2. The torque wrench of claim 1, wherein each of said beams is rigid.

3. The torque wrench of claim 1, wherein said head is a ratchet head.

4. The torque wrench of claim 1, wherein said head is rotatable about a torquing axis, said output beam being pivotable about said axis.

5. A low-profile ratcheting torque wrench comprising:

an elongated torque input housing having a predetermined maximum thickness and having a handle end and a work end, a ratchet head mounted within said housing at the work end thereof for rotation relative thereto about an axis and having a work-engaging lug projecting from the housing along the axis, an elongated output beam disposed within the housing and coupled to the ratchet head and movable relative to the housing in response to applied torque, a bias mechanism coupling said beam to said housing and urging said beam to a neutral position relative to said housing while accommodating continuous movement of said beam from said neutral position a distance which is a function of the amount of torque applied, and an electronic indicator carried by the housing and responsive to relative movement between the housing and the output beam for providing an indication of torque applied.

6. The torque wrench of claim 5, wherein said housing has a substantially uniform thickness along its entire length.

7. The torque wrench of claim 5, wherein said housing and said beam are rigid.

8. The torque wrench of claim 7, wherein said beam is pivotably movable about said axis.

9. The torque wrench of claim 5, wherein said bias mechanism includes two springs respectively engaged with opposite sides of said beam and respectively urging it in opposite directions.

10. A torque wrench comprising:

an elongated torque input beam having a handle end and a work end;

a work-engaging head rotatably carried by said input beam at the work end thereof;

an elongated output beam disposed substantially parallel to said input beam and having an output end fixed to said head for rotation therewith and an input end;

a bias mechanism coupling said input beam to the input end of said output beam and resiliently urging said input end to a neutral position relative to said input beam while accommodating continuous movement of said input end from said neutral position a distance which is a function of the amount of torque applied; and an indicator responsive to movement of said input end from said neutral position for providing an indication of torque applied, said indicator including two spaced-apart permanent magnets and a Hall-effect sensor disposed between said permanent magnets and carried by said input end of said output beam, a display coupled to said Hall-effect sensor for displaying torque values, a preset circuit for presetting a predetermined torque level displayed on said display, and an alarm device coupled to said preset circuit and to said Hall-effect sensor for producing an alarm indication when the torque measured by the Hall-effect sensor equals said predetermined torque level.

11. The torque wrench of claim 10, and further comprising a switch mechanism coupled to said preset circuit and to said Hall-effect sensor and to said display and switchable between a preset condition in which said display displays the torque value set by said preset circuit, and an applied torque condition wherein said display displays the torque level sensed by said Hall-effect sensor.

12. A low-profile ratcheting torque wrench comprising:

an elongated torque input housing having a predetermined maximum thickness and having a handle end and a work end;

a ratchet head mounted within said housing at the work end thereof for rotation relative thereto about an axis and having a work-engaging lug projecting from the housing along the axis;

an elongated output beam disposed within the housing and coupled to the ratchet head and movable relative to the housing in response to applied torque; and an electronic indicator carried by the housing and responsive to relative movement between the housing and the output beam for providing an indication of torque applied, said indicator including two spaced-apart permanent magnets and a Hall-effect sensor disposed between said permanent magnets and carried by said input end of said output beam, a display coupled to said Hall-effect sensor for displaying torque values, a preset circuit for presetting a predetermined torque level displayed on said display, an alarm device coupled to said preset circuit and to said Hall-effect sensor for producing an alarm indication when the torque measured by the Hall-effect sensor equals said predetermined torque level, and a switch mechanism coupled to said preset circuit and to said Hall-effect sensor and to said display and switchable between a preset condition in which said display displays the torque values set by said preset circuit, and an applied torque condition wherein said display displays the torque level sensed by said Hall-effect sensor.

* * * * *